US005890833A

United States Patent [19]

Allen et al.

[11] Patent Number: 5,890,833

[45] Date of Patent: Apr. 6, 1999

[54] HYDRAULICALLY CONTROLLED RIDING TROWEL

[75] Inventors: J. Dewayne Allen, Paragould, Ark.; Michael W. McKean, Arlington, Tenn.

[73] Assignee: Allen Engineering Corporation, Paragould, Ark.

[21] Appl. No.: 784,244

[22] Filed: Jan. 15, 1997

[51] Int. Cl.[6] ..... E01C 19/22

[52] U.S. Cl. ..... 404/112

[58] Field of Search ..... 404/112; 251/129.01, 251/129.04, 129.05; 172/7; 416/147, 148, 149, 156, 159

[56] References Cited

U.S. PATENT DOCUMENTS

| | | | |
|---|---|---|---|
| 3,412,657 | 11/1968 | Colizza et al. | 404/112 |
| 3,936,212 | 2/1976 | Holz, Sr. et al. | 404/112 |
| 4,046,484 | 9/1977 | Holz, Sr. et al. | 404/112 |
| 4,553,731 | 11/1985 | Carpenter | 251/27 |
| 4,929,201 | 5/1990 | Pitt | 440/50 |
| 5,108,220 | 4/1992 | Allen et al. | 404/112 |
| 5,480,258 | 1/1996 | Allen | 404/112 |
| 5,503,232 | 4/1996 | Matsushita et al. | 172/2 |
| 5,664,637 | 9/1997 | Ohta et al. | 180/286 |

*Primary Examiner*—Tamara L. Graysay
*Assistant Examiner*—Sunil Singh
*Attorney, Agent, or Firm*—Stephen D. Carver

[57] ABSTRACT

A high performance, multiple rotor riding trowel for finishing concrete and hydraulic controls therefor, enabling complete hand control to the operator of steering, propulsion, and blade pitch. A rigid trowel frame mounts two or more downwardly-projecting, bladed rotor assemblies that frictionally engage the concrete surface. The rotor assemblies are tilted with double acting hydraulic cylinders to effectuate steering and control. Double acting hydraulic cylinders also control blade pitch. A joystick system enables the operator to hand control the trowel with minimal physical exertion. The joystick system activates solenoid control valves that in turn energize the various hydraulic cylinders that tilt the rotors and alter blade pitch. The rotor gearboxes are mounted to tiltable, pivot steering boxes secured to the frame within suitable mounting regions bounded by rigid frame elements. The rotor assembly blades contact plastic concrete to finish the surface while supporting the trowel.

12 Claims, 15 Drawing Sheets

150
150A
150B
200
200A
200B
ENGINE
TROWEL
220
221
222
223
224
225
226
226B
227
227A
227B
228
229
230
230A
230B
232
240
240A
240B
241
242
243A
243B
243C
244A
244B
244C
245
247A
247B
247C
250
251
253
254
255
255A
256
260A
260B
260C
A1
A2
A3
A4
A5
A6
B1
B2
B3
B4
B5
B6
P1
P2
P3
T

HYDRAULICALLY CONTROLLED RIDING TROWEL

BACKGROUND OF THE INVENTION

1. Field of the Invention

This invention relates generally to motorized riding trowels for finishing concrete surfaces, and to steering and blade pitch control systems therefor. More particularly, the present invention relates to control systems for self-propelled riding trowels, and to trowels equipped with such systems. Representative prior art self-propelled riding trowels are classified in United States Patent Class 404, Subclass 112.

2. Description of the Prior Art

Self-propelled, motorized riding trowels have become widely accepted in the concrete finishing arts. High-power, multiple engine riding trowels are particularly effective. They can finish large surface areas of wet concrete much more efficiently than single engine riding trowels or the older "walk behind" trowels. Significant savings are experienced by the contractor using such equipment, as time constraints and labor expenses are reduced.

Typical motorized riding trowels employ multiple, downwardly projecting rotors. The rotors contact the concrete surface for finishing concrete and support the weight of the trowel. Typically each rotor comprises a plurality of radially spaced apart finishing blades that revolve in frictional contact with the concrete surface. The blades may be coupled to circular finishing pans for treating green concrete. The rotors and their revolving blades are responsible for steering and propulsion. To effectuate steering the rotors are tilted to generate differential forces.

Generally speaking, the more powerful the trowel, the faster finishing operations can be completed. However, the more powerful the trowel, the more difficult it can become to steer the machine. Crisp, responsive handling is important to optimize the efficiency of the troweling process, and to preserve operator safety and comfort.

Holz, in U.S. Pat. No. 3,936,212 describes a three-rotor trowel powered by a single engine. Devices of this nature are difficult to steer, in part because the manually-operated steering linkages that are conventionally employed are inefficient and cumbersome. Further, the drive motor linkages are unreliable and inordinately complex. In U.S. Pat. No. 4,046,484 Holz discloses a twin rotor trowel that is the forefather of many twin rotor designs presently on the market. Trowel steering and propulsion is effectuated by the combination of rotor tilting and blade twisting. Both prior art Holz devices are powered by a single motor. The rotors are driven by an engine mounted on the frame. By tilting the axis of rotation of the rotors, steering and directional control are varied. Frictional forces developed as the blades (or pans) revolve upon the concrete surface resolve into propulsion forces that move the trowel.

Notwithstanding their advantages over older manual systems, early riding trowels based upon the original Holz design were cumbersome and difficult to control. For steering the rotors were tilted with manually operated lever arrangements that projected upwardly from the machine frame. The operator was required to manually control the levers, and a vigorous physical effort was required. The steering characteristics of the trowel disclosed in U.S. Pat. No. 5,108,220, which is owned by the same assignee as in this case, are enhanced. The latter reference discloses a fast steering, high power, twin rotor riding trowel that substantially enhances maneuverability and control over prior twin-rotor machines. Physical labor of the driver is reduced, as the improved linkages and offset couplings therein reduced the effort required to tilt the rotors. However, the driver is nevertheless required to manually deflect levers to steer and control the device.

Significant riding-trowel power is required if large areas of concrete are to be trowelled in a short period of time. U.S. Pat. No. 5,480,258, which is owned by the same assignee as in this case, discloses a multiple engine riding trowel. The twin rotor design depicted therein associates a separate engine with each rotor. As the engines are disposed directly over each revolving rotor assembly, horsepower is more efficiently transferred to the revolving blades. Besides resulting in a faster and more efficient trowel, the design is easier to steer. Again, manually activated steering linkages are used.

Twin-rotor trowels can have "overlap" problems. When the rotors are spaced apart from one another for clearance purposes, an unfinished region between the revolving blades results. To remedy the overlap problem, earlier twin rotor riding trowels meshed their rotor blades to avoid these unfinished intermediate areas. Such designs require synchronization of the propeller-like rotor blades to avoid destructive interference. This timing problem complicates transmission design, especially in single engine riding trowels. In multiple engine designs meshed rotors necessitate properly synchronized motors.

Prior approaches at motor synchronization have been difficult electronically and dangerous mechanically. Another consideration mitigating against the use of meshed rotor trowels is that such designs cannot easily handle finishing pans. Such pans are used to treat green or wet concrete during early stages of the finishing process. They are attached to rotors by seating the rotor blades within suitable brackets. However, they generally cannot be used on trowels where rotor spacing meshes the blades, as adjacent pans collide. To fit pans the rotor spacing must be increased. However, in twin rotor machines if the rotor spacing is increased to accommodate pans, the gap between adjacent rotor blades increases.

Systems that have more than two rotors easily "cover" the intermediate surface area between adjacent rotors, thus avoiding the overlap problem. Coverage results whether the trowel is running blades or finishing pans. Significantly, there is no rotor synchronization requirement in a three or four rotor trowel, as the blades need not be meshed to avoid the overlap problem. However, as rotors are added, drive horsepower must be increased. Steering linkage complexity is aggravated as multiple rotors are added. Further, where separate engines are used with each rotor assembly, more and more physical effort is required to manually tilt the rotors for steering, or to vary blade pitch.

SUMMARY OF THE INVENTION

The improved riding trowel disclosed herein employs a unique hydraulic system to effectuate full "powered" control. Hydraulic circuitry of the instant invention facilitates steering and propulsion by tilting the rotors; concurrently the system remotely varies and controls blade pitch. Preferably joystick controls are interconnected through appropriate circuitry to activate the hydraulics. In the best mode, each rotor assembly has a separate motor. In an exemplary mode illustrated herein, a high power riding trowel employs three separate rotor assemblies, each equipped with an independent engine. Significant improvements in trowel performance and handling are realized. As a result, the operator can steer the device with a minimum of physical effort.

The hydraulic control circuitry is interconnected with the rotor assemblies for both steering and/or blade pitch control. Prior twin rotor designs require that at least one rotor assembly be tilted for motion within two separate planes for steering. By uniting hydraulic control with a three rotor design, each rotor assembly need only tilt in one plane. Preferably, in a three rotor design, the third rotor lilts within a plane that is vertically perpendicular to the biaxial plane of tilling established between the other two rotors. Independently suspended rotors cooperate to avoid overlap problems. The third, front-mounted rotor finishes the concrete zone between the two, rear rotors.

The trowel comprises a rigid frame that supports multiple rotor assemblies. Preferably, but not necessarily, each rotor assembly has a separate internal combustion engine. The frame internally defines separate compartments associated with each rotor assembly. Each rotor assembly comprises a gear box mounted to a pivot steering box, both of which are secured within the corresponding frame compartment.

Steering and blade pitch linkages are hydraulically actuated. Levers, preferably joysticks, accessible to the seated operator enable complete control of the apparatus. Hydraulic horsepower is obtained from a suitable pump driven by the trowel motor(s). Trowels may be equipped with either with electric engines or internal combustion engines powered by gasoline, diesel, or gas.

Thus a fundamental object of the invention is provide a powered control system for riding trowels.

Another fundamental object is to hydraulically provide power steering and power blade pitch control in multiple-rotor riding trowels.

Another important object is to provide an electrical-over-hydraulic steering and control system for riding trowels that is lever or joystick controlled.

Another important object is to simplify the operation of high power riding trowels.

A related object is to reduce the physical effort required to safely drive a riding trowel.

Another fundamental object is provide a high speed, high power riding trowel that is extremely easy to steer.

Another basic object is to provide a power steering system for a high speed trowel that quickly and efficiently delivers its considerable horsepower to multiple rotor assemblies.

It is also an object to provide power steering for riding trowels that works efficiently while running either blades or pans.

A still further object is to provide a hydraulic control circuit of the character described that will function on a variety of riding trowels, including two rotor and three rotor designs.

Another important object is to provide a high power riding trowel that overcomes power-draining vacuum effects that occur when panning wet concrete.

Another object is to provide a power steering system for high speed, high power riding trowels that have separate drive motors associated with each rotor.

Another fundamental object is to independently, hydraulically control each of the rotors in a multiple rotor trowel.

A related object is to provide an electrical control system for actuating the hydraulic system in a multiple rotor trowel design. It is a feature of this invention that "joystick steering" is employed for ultimate trowel ride control in conjunction with the hydraulics.

Yet another significant object of the present invention is to significantly enhance the handling characteristics of high powered, multiple-engine riding trowels.

A related object is to provide a multiple-rotor trowel that mechanically isolates each rotor from the others.

Another basic object of the invention is minimize the complexity of rotor steering in a multiple rotor trowel.

A related object is to isolate each rotor from shocks experienced by the other.

Another basic object is to provide a power steering system for riding trowels that works with either standard rotation or contra rotation.

Yet another important object is to provide a power steering equipped riding trowel wherein the rotors flatten the concrete surface sufficiently to attain the high "F-numbers" (i.e., flatness characteristics) that are established by certain ACI regulations.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 14:
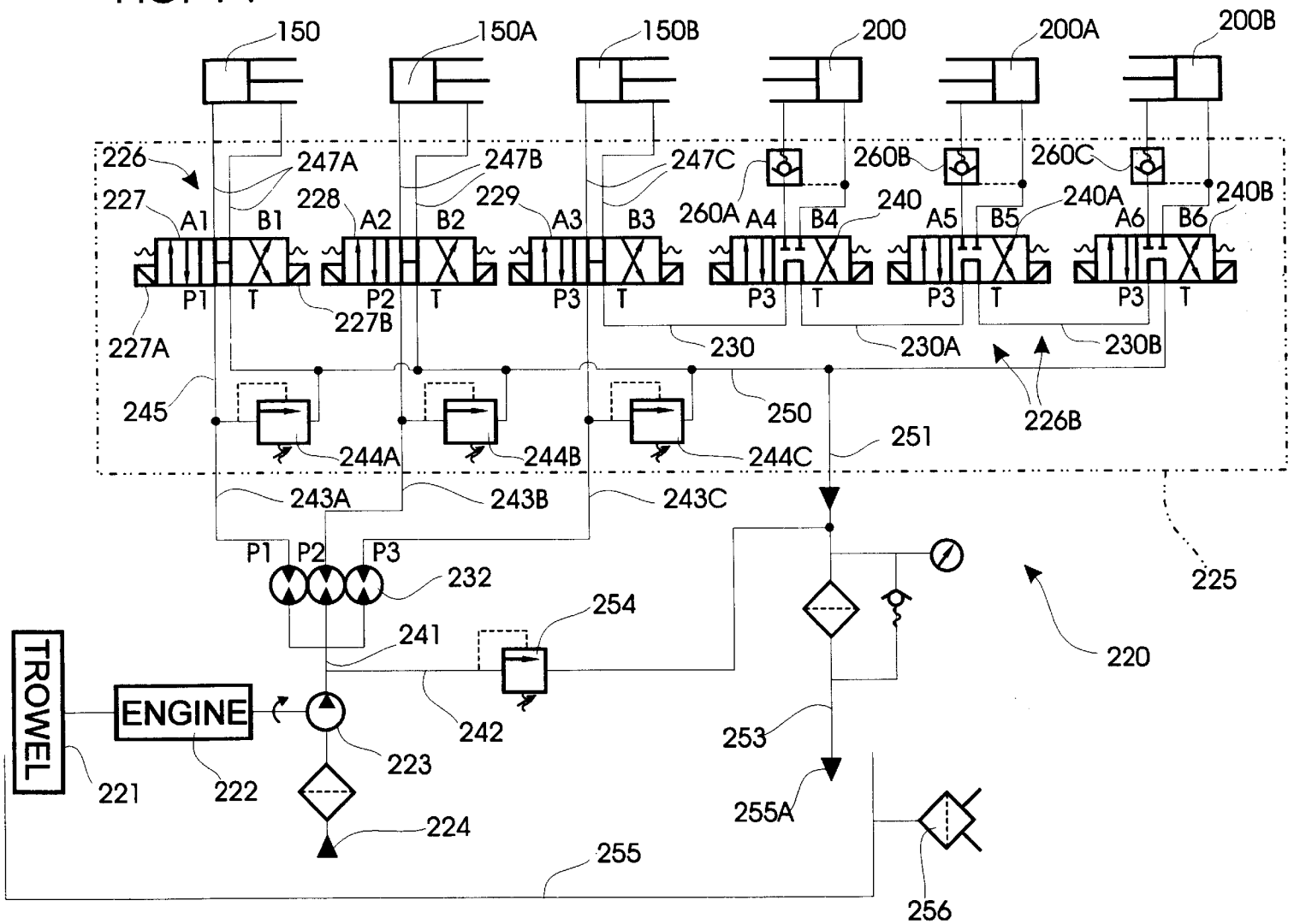
FIG. 14 is a schematic diagram of the preferred hydraulics.

With attention directed initially to FIGS. 1–4 of the accompanying drawings, reference numeral 20 denotes a high power riding trowel equipped with hydraulic steering. The hydraulic system is best illustrated in FIG. 14 to be discussed hereinafter. Although the steering concepts of the instant invention can be employed with twin or four-rotor trowels, the illustrated trowel 20 comprises three separate rotor assemblies. Each rotor assembly is independently, pivotally suspended from the rigid frame. Preferably each rotor assembly is driven by a separate engine as discussed below, and both the rotor and the motor pivot in a single plane. The self propelled trowel 20 is designed to quickly and reliably flat finish large areas of concrete surface 21.

Figure 15:
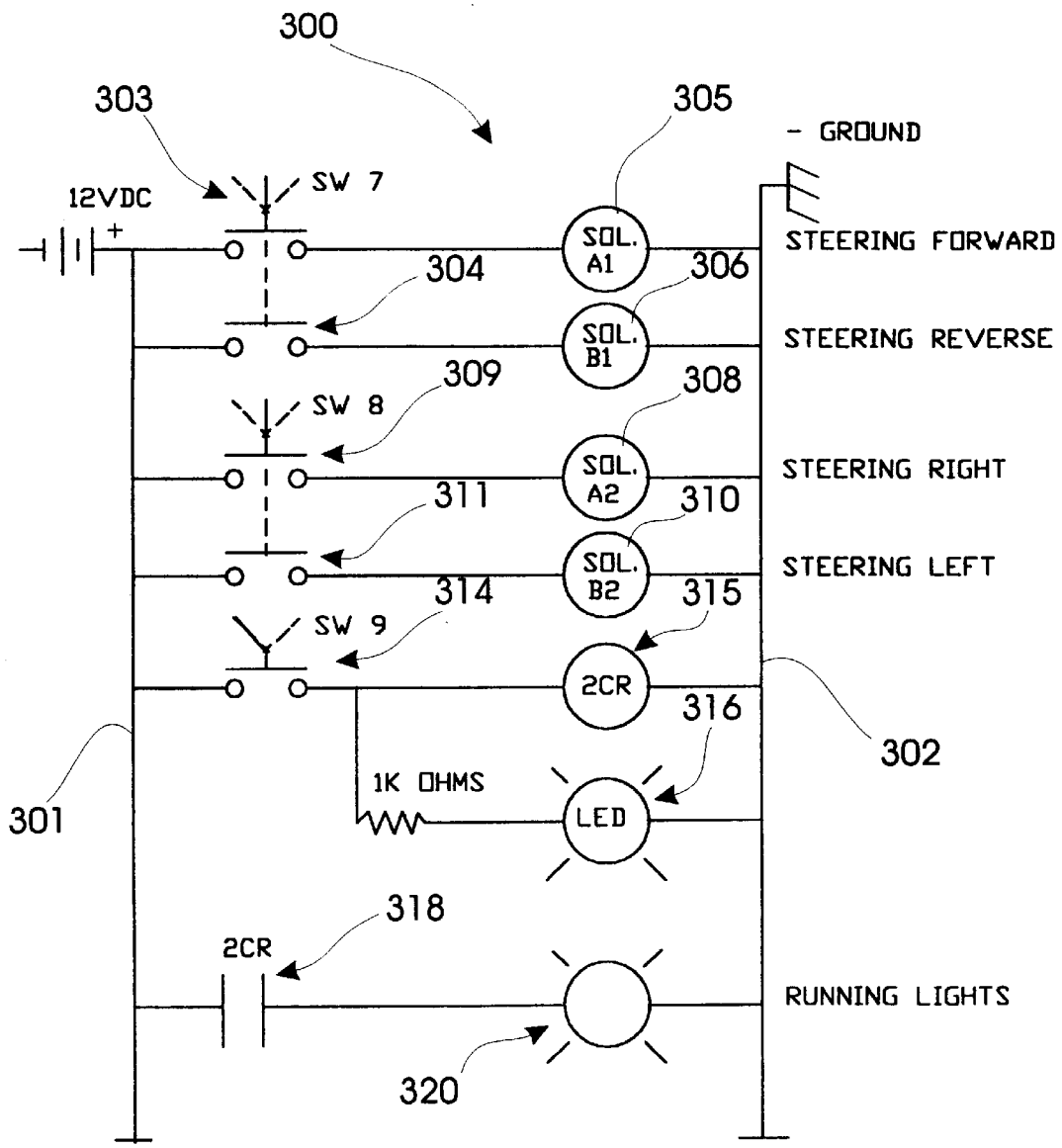
FIG. 15 is an electrical schematic of the right hand joystick control circuit; and, FIG. 16 is an electrical schematic of the left hand joystick control circuit.

An operator (not shown) comfortably seated within seat assembly 23 can operate the entire machine with an easy-to-use lever controlling system comprising, in the best mode, left joystick 24B and right joystick 24A. The left hand joystick 24B is preferably wired according to circuit 400 (FIG. 16) and the right hand joystick 24A is preferably wired according to circuit 300 (FIG. 15). A foot-operated motor throttle control 74 (FIG. 1) is accessible from seat assembly 23.

Figure 1:
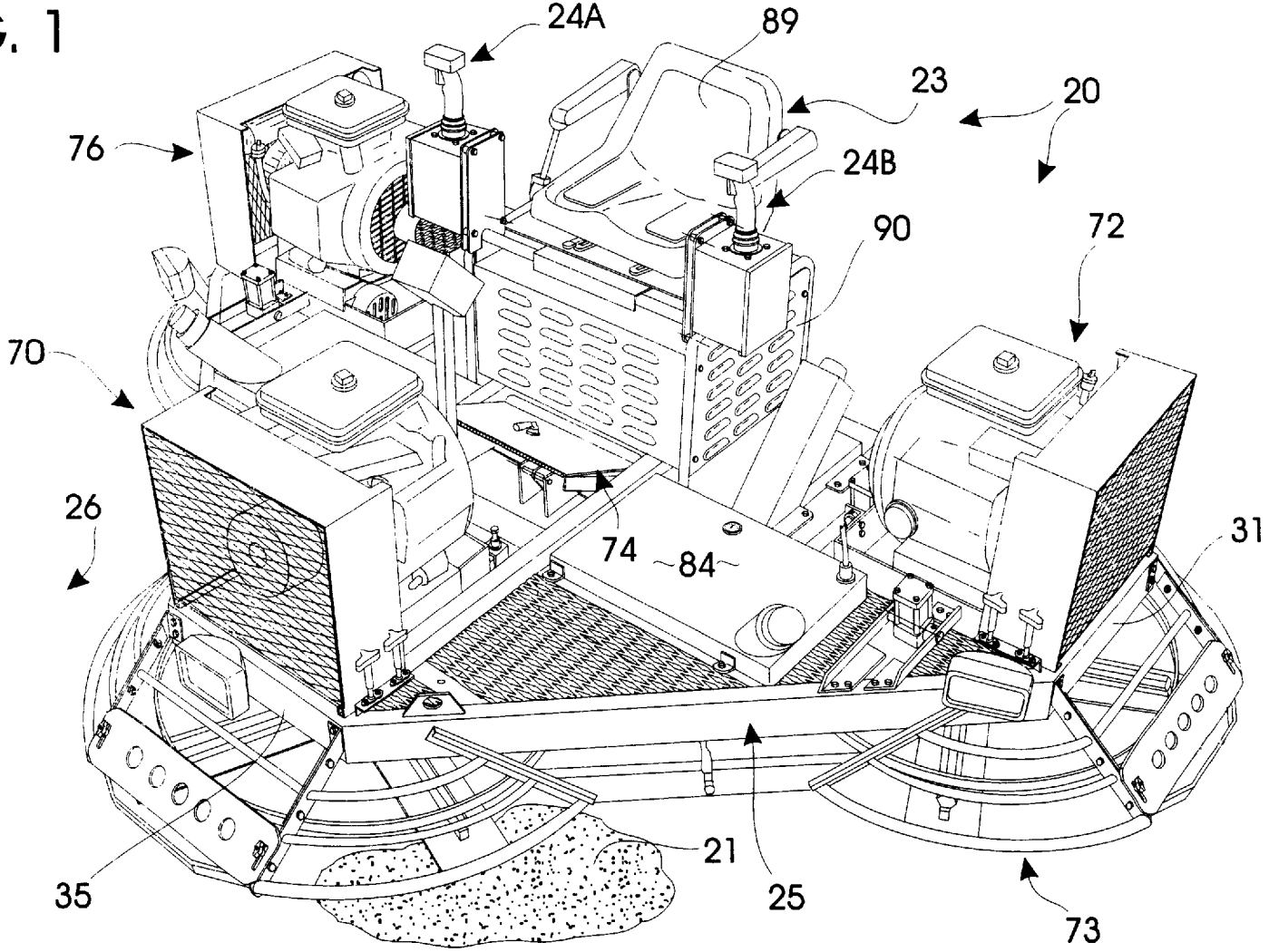
FIG. 1 is a front, environmental, perspective view of a high speed, multiple rotor trowel showing the best mode of the invention known at this time.
Figure 2:
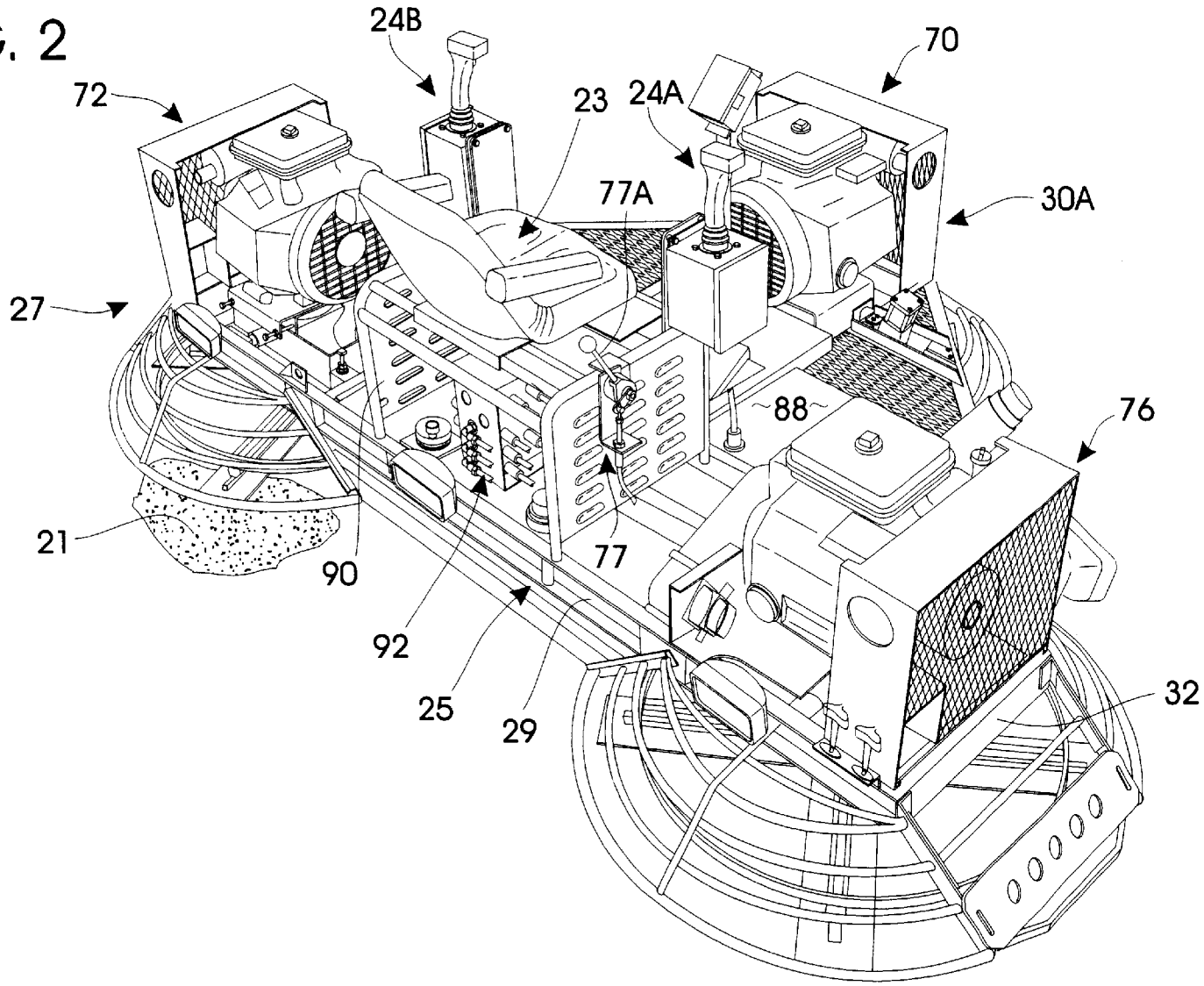
FIG. 2 is a fragmentary rear perspective view of the trowel.

Trowel 20 has a rigid metallic frame 25 fabricated from channel steel. In the three rotor mode the frame is triangular, and comprises a front 26 (FIG. 1) and a rear 27 (FIG. 2). A transverse base 29 extends across the rear 27 of the frame between frame ends 31, 32. Ends 31, 32 are rigidly affixed to frame sides 33, 34 which form the sides of a triangle and terminate at a transverse, frame front 35. The frame is internally reinforced by transverse strut 40 that is parallel with and spaced apart from base 29. The parallel frame braces 42, 44 extend from strut 40 to front 35 to further reinforce the frame. Similarly transverse struts 46, 47 (FIGS. 3, 4) extend between braces 44, 42 to sides 33, 34 respectively for reinforcement.

Figure 3:
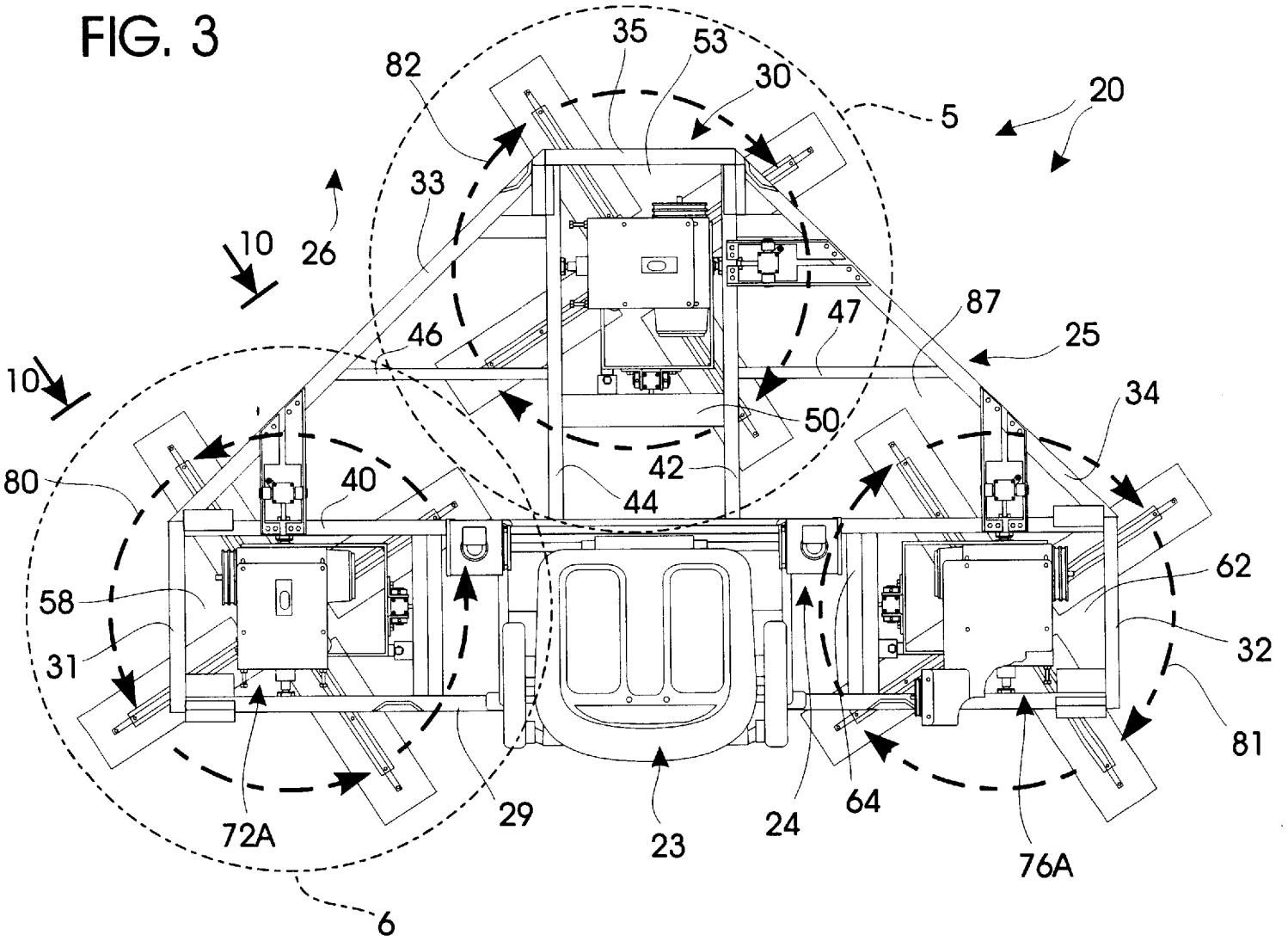
FIG. 3 is a fragmentary top plan view with portions thereof omitted or broken away for clarity.
Figure 5:
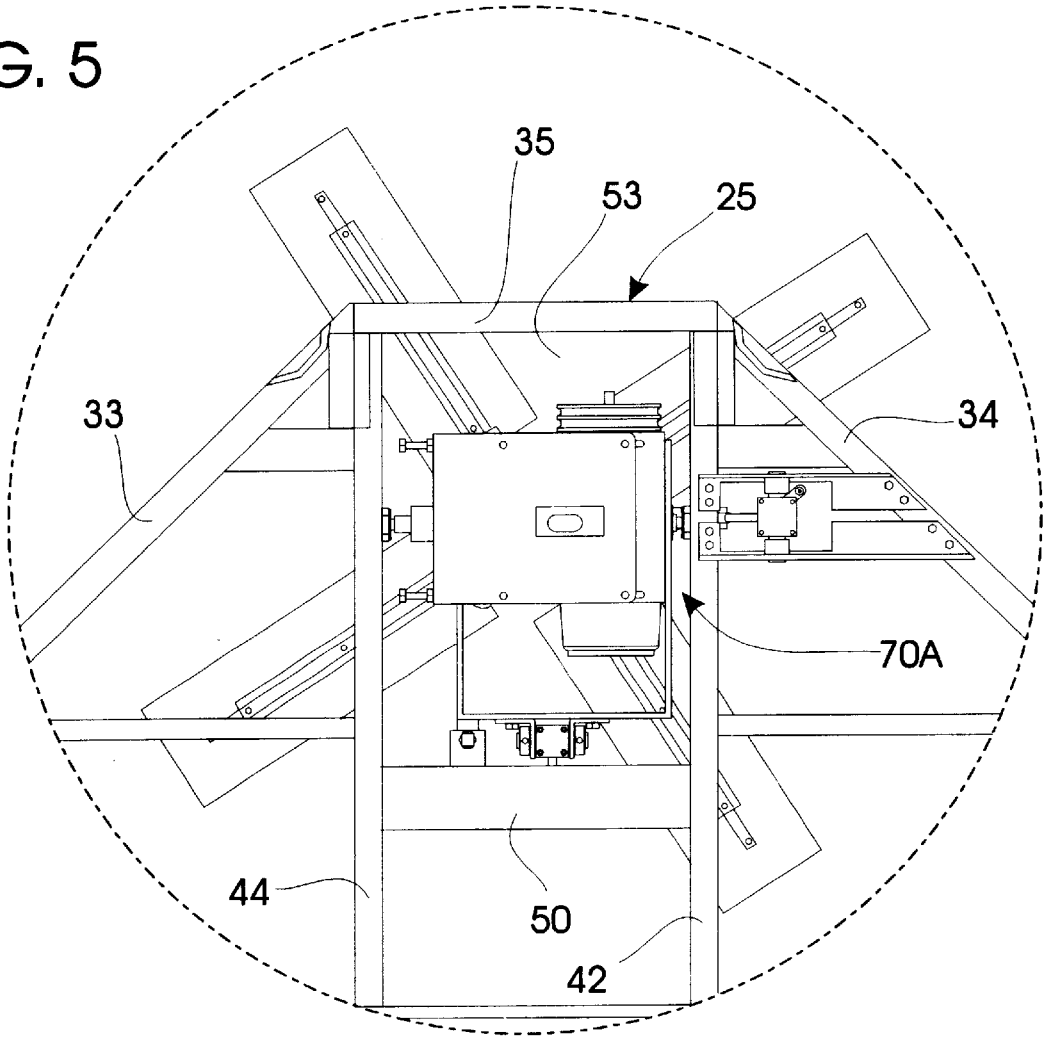
FIG. 5 is an enlarged, fragmentary, top plan view of circled portion 5 of FIG. 3, with portions thereof broken away for clarity or omitted for brevity.
Figure 6:
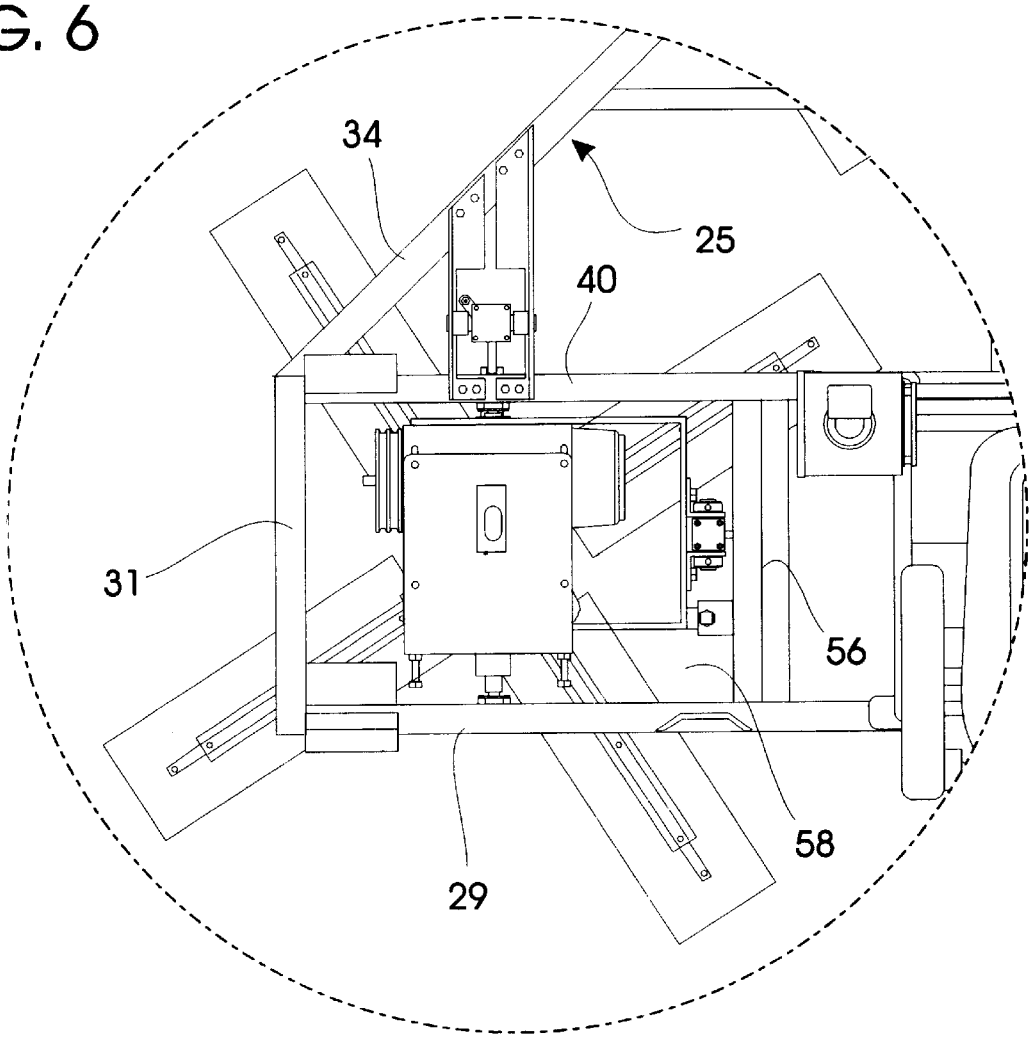
FIG. 6 is an enlarged, fragmentary top plan view of circled portion 6 in FIG. 3, with portions broken away for clarity or omitted for brevity.
Figure 7:
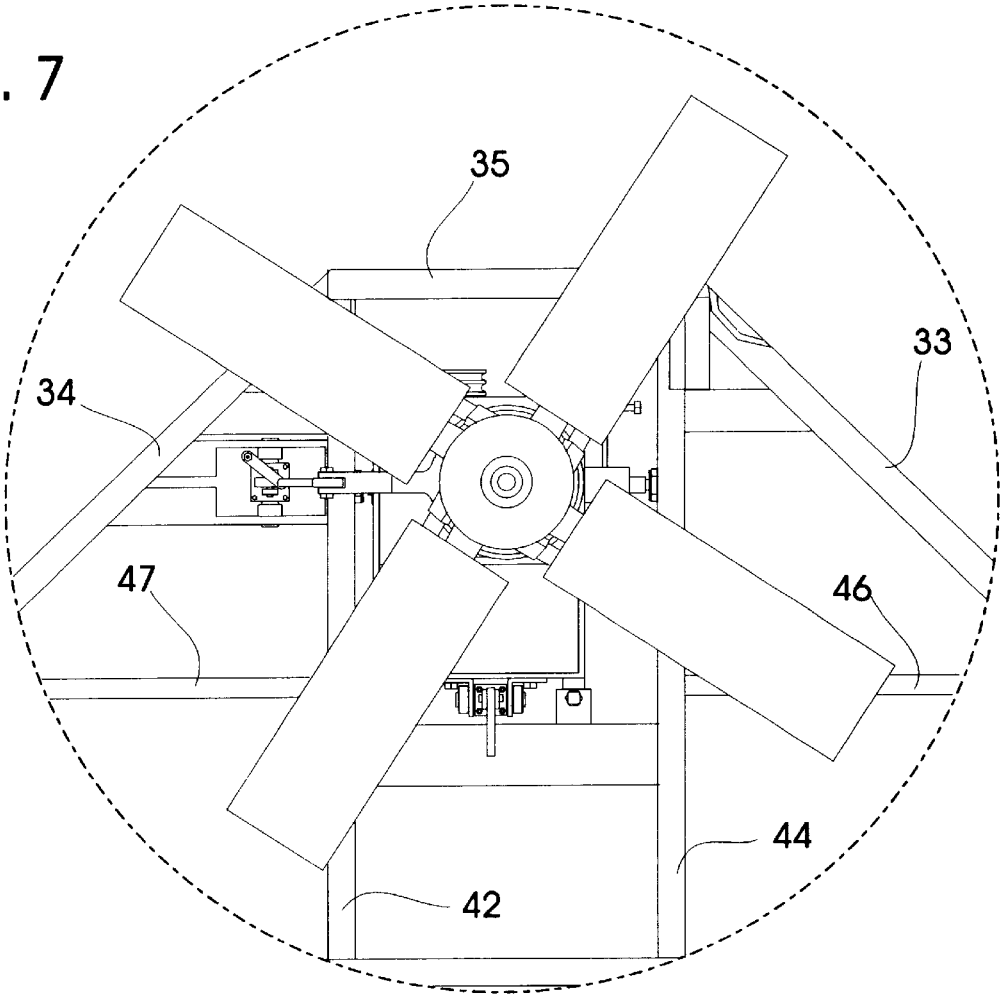
FIG. 7 is an enlarged, fragmentary bottom plan view of the frame front taken generally from the underside of FIG. 5, with portions broken away for clarity or omitted for brevity.
Figure 8:
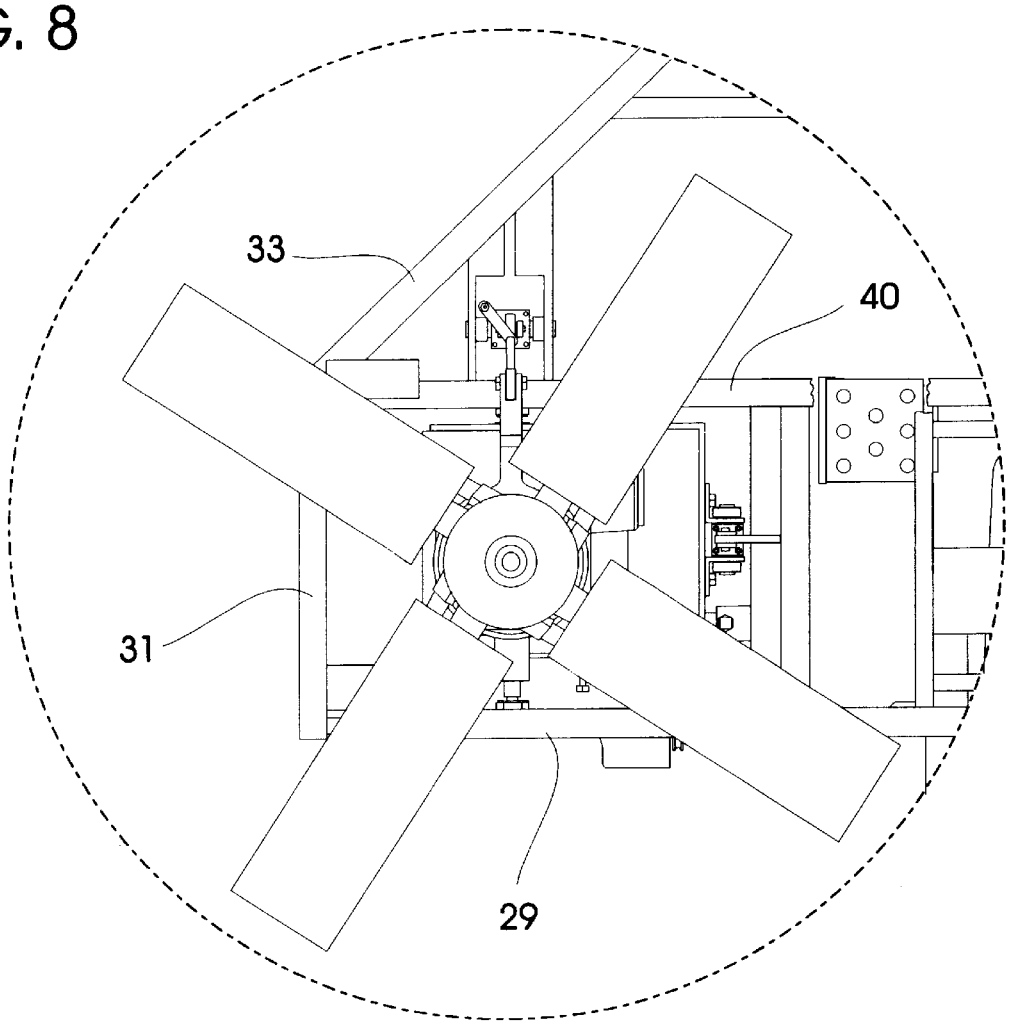
FIG. 8 is an enlarged, fragmentary bottom plan view of the left side of the frame, taken generally from the underside of FIG. 6, with portions broken away for clarity or omitted for brevity.

An internal brace 50 that is parallel with and spaced apart from front 35 extends between braces 42, 44 (FIGS. 3, 5). A recessed gearbox mounting region 53 is defined between brace 50, front 35 and braces 42, 44. In the best mode, each rotor assembly is pivotally disposed within a similar frame mounting region defined between adjacent and intersecting frame elements. The left rear of the frame is reinforced with a doubled, channel steel brace 56 that extends between frame base 29 and strut 40. A recessed gearbox mounting region 58 (FIGS. 6, 9) for the left rear rotor is defined between frame end 31, brace 56, strut 40 and base 29. Similarly, recessed gearbox mounting region 62 (FIG. 3) for the right rear rotor is defined between frame end 32, brace 64, strut 40 and base 29.

Figure 4:
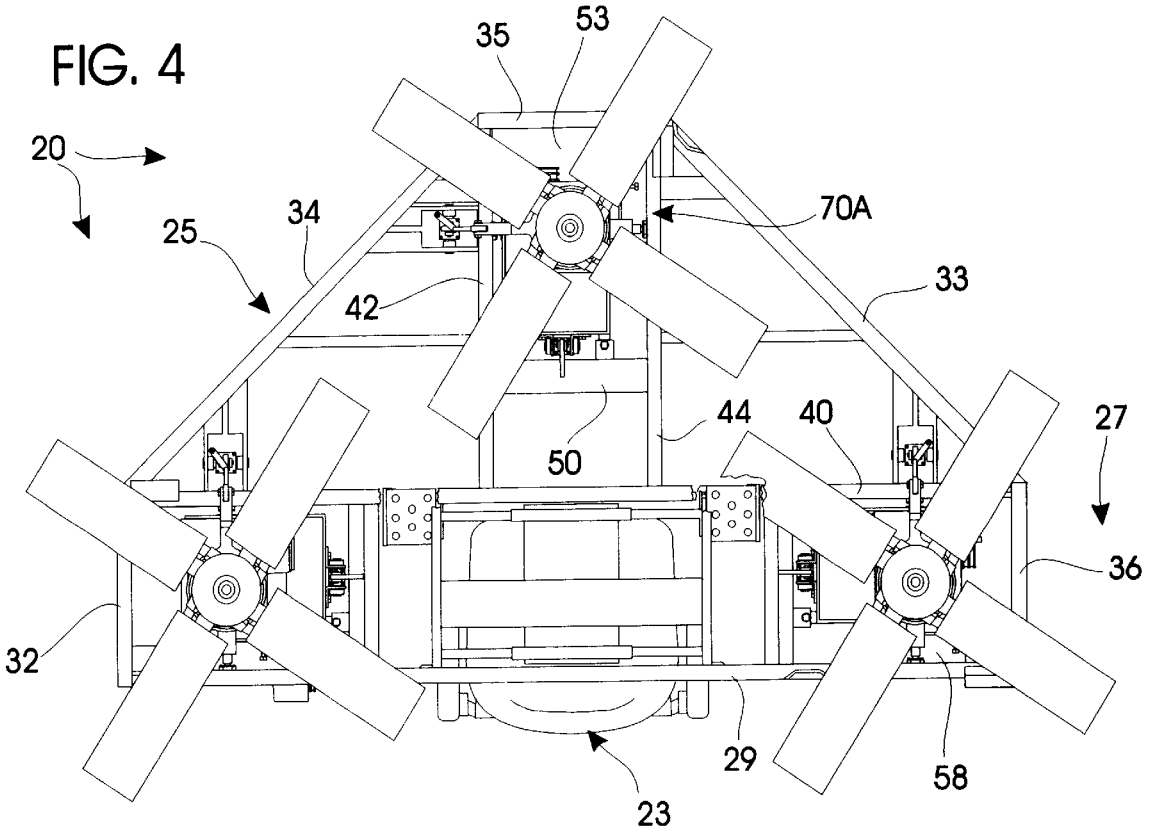
FIG. 4 is a fragmentary, bottom plan view with portions omitted for clarity.

Trowel 20 preferably comprises three separate bladed rotors that support the trowel upon the concrete surface 21. Alternatively, the steering system can be employed with trowels having more or less rotor assemblies. For example, it is contemplated that the instant steering system can be used with twin-rotor riding trowels, whether powered with a single engine or twin engines. In the best mode, however, each rotor assembly is powered by a separate engine. For example, in trowel 20 a front motor 70 drives a front rotor assembly 70A (FIGS. 4, 5). The left rear motor 72 drives rotor assembly 72A (FIGS. 1, 3). Similarly the right rear motor 76 independently drives rotor assembly 76A.

In the best mode the left and right rear rotors revolve in the opposite radial directions indicated by arrows 80, 81 (FIG. 3). The latter is termed "contra-rotation." Such rotation is also preferred with twin rotor trowels. In the best mode known to us at this time the front rotor (i.e., in a triple rotor trowel) revolves in a clockwise direction indicated by arrow 82 (FIG. 3). When the rear rotors revolve in this preferred "contra-rotation" mode they press incoming concrete about the trowel periphery during forward trowel movement. However it is within the scope of the invention to employ "standard rotation" wherein the rear rotors revolve oppositely from arrows 80, 81. The latter, although not preferred, is referred to as "standard rotation." In the latter mode the rotors press incoming concrete toward the trowel center and between the rotors during forward movement. Standard rotation may be employed by twin rotor trowels as well.

Preferably, the rotor assemblies 70A, 72A and 76A are powered by belt-driven gear boxes that are clutch driven by the internal combustion motors. Details as to the construction of typical gear boxes, motor linkages, rotor blade linkages, clutch connectors, blade pitch controls and the like may be found in my prior U.S. Pat. Nos. 5,108,220 and 5,480,258 which are hereby incorporated by reference. Each rotor is protectively shrouded by a cage assembly 73 that prevents human contact with the revolving rotor blades that frictionally finish the concrete surface.

A first fuel tank 84 (FIG. 1) is recessed within the frame area 83 defined between struts 40, and 46. A companion fuel tank 88 (FIG. 2) is mounted within mounting region 87 (FIG. 3) defined between internal frame struts 40, 47. The seat assembly 23 comprises a chair 89 disposed upon a ventilated, upright enclosure 90 positioned between the motors 72, 76. Enclosure 90 houses a battery (not shown) for the electrical system and a hydraulic valve system for controlling the hydraulic actuators to be hereinafter discussed. A cruise control 77 (FIG. 2) is accessible from the right side of the seat to lock in selected motor speed. Cables (not shown) from the variable foot control 74 (FIG. 1) establish motor speed by displacing the motor throttle linkages (not shown). Handle 77A may be conveniently grasped by the user to lock the throttles in a cruise control mode.

Figure 9:
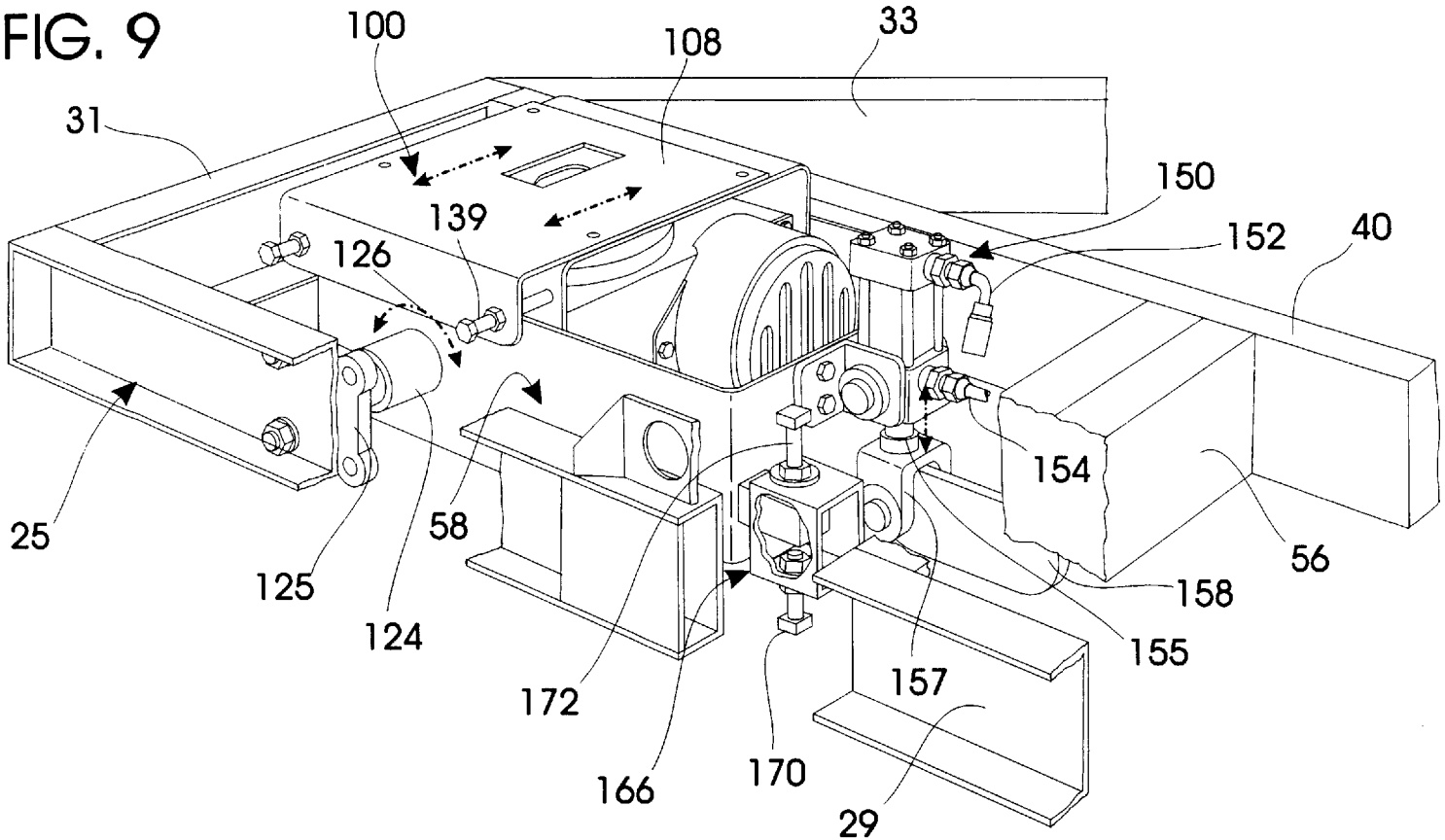
FIG. 9 is an enlarged, fragmentary rear isometric view of the frame, with portions broken away or omitted for clarity, showing a typical rotor assembly mounting.

FIG. 9 shows the left rear frame assembly of trowel 20 wherein the rotor assembly gear box is fitted within mounting region 58. The rotor assemblies are substantially similar structurally, except for tilting and mounting angles, and so only one will be described in detail. A preferred rotor assembly pivot system has been generally designated by the reference numeral 100 (FIG. 9). Each rotor assembly comprises a generally cubical gear box 102 (FIG. 11) that is pivotally disposed within the mounting region 58 (FIG. 9) defined by the frame struts previously discussed. The rotor gear box 102 is driven through a pair of pulleys 104 and belts 105 (FIG. 11) extending to a clutch driven by internal combustion motors 70, 72, or 76 (FIG. 1) that is adjustably secured at the top of the assembly to the motor mounting plate 108. The gear box 102 is mounted within the pivot steering box 109 (FIG. 11) of generally U-shaped cross section. Pivot steering box 109 comprises opposite, parallel sides 111, 112 which are secured with a plurality of fasteners 115 that penetrate orifices 116, 116A and are received within internally threaded orifices 117 in the sides 102A of the gear box 102. A top plate 120 is nested about the gear box with its opposite, downwardly projecting sides 121, 122 sandwiched between the gear box sides and the pivot steering box sides 111, 112.

A pair of trunnions 124 (FIG. 11) are rigidly secured to the sides 111, 112 of the pivot steering box 109, and extend outwardly therefrom. These trunnons support the rotor assembly for pivoting. The trnnions are journalled within suitable bearings 125 (FIG. 9) so that the rotor may be pivoted back and forth in the direction of arrow 126. As the pivot steering box is so deflected within the mounting region 58, the motor is pivoted as well. As explained in my prior United States patents, steering of riding trowels is effectuated by such tilting.

Figure 11:
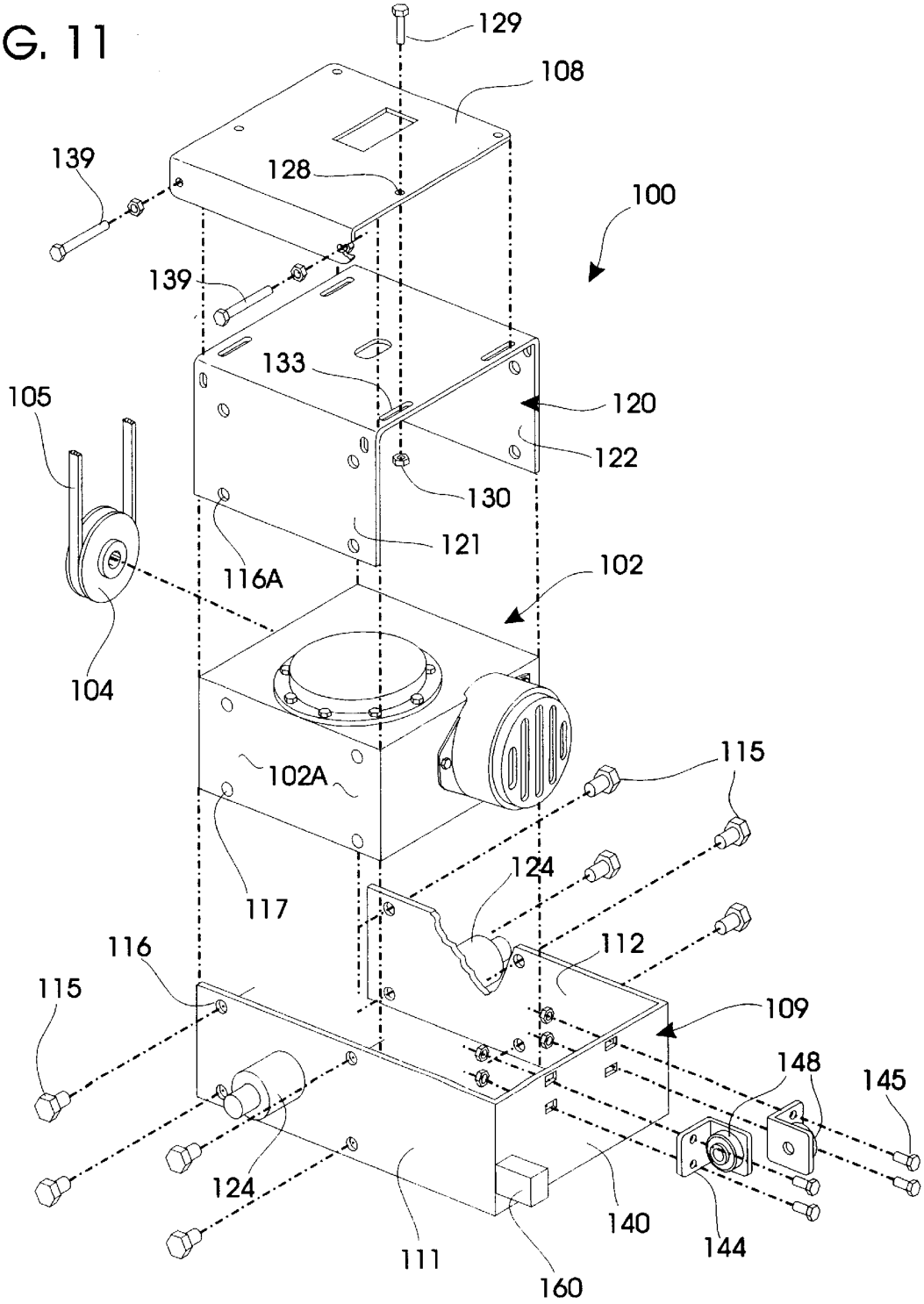
FIG. 11 is an exploded isometric view of a preferred rotor mounting system.

In the best mode the internal combustion motors 70, 72, and 76 are secured to the motor mounting plate 108 (FIG. 9) which is in turn secured to plate 120 sitting atop the gear box. Suitable fasteners 129 penetrate portions of the mounting feet (not shown) provided on the motors and orifices 128 are secured by nuts 130. Plate 108 may be moved relative to lower plate 120 as fasteners 126 register within slots 133 (FIG. 11). When the motor is properly aligned the bolts 139 are appropriately tightened. Each rotor assembly preferably mounts its motor similarly.

The front face 140 of the pivot steering box 109 is mechanically deflected for pivoting. A pair of L-brackets 144 extend outwardly from face 140 being mounted by fasteners 145. These brackets mount bearings 148 that receive a suitable shaft (not shown) extending through the base of a tilting cylinder or actuator 150B (FIG. 9). The actuator preferably comprises a double acting, solenoid-controlled, hydraulic cylinder. As explained hereinafter, it is activated by suitable valves through hydraulic lines 152, 154. Rod 155 drives a clevis 157 that is pivotally connected to a stationary frame member 158. As rod 155 (FIG. 9) is extended or retracted in response to hydraulic pressure, the pivot steering box 109, the gear box and the motor (i.e., the entire rotor assembly) are pivoted generally as indicated by arrow 126 (FIG. 9).

A rigid pivot stop 160 (FIG. 11) projects outwardly from pivot steering box face 140. This stop is received within a rigid, somewhat cubicle enclosure 166 (FIG. 9) that establishes the maximum travel of stop 160 in a pivoting arc. To this effect, travel ends when stop 160 hits either end of bolt 170 or 172 within housing 166. Thus stop 160 limits travel when it engages the end of adjustable bolts 170 or 172 that project into the bottom or top of the housing 166 respectively. As best viewed in FIG. 9, bolts 170, 172 can be adjusted to limit the amount of hydraulic pivoting by appropriately adjusting the jam nuts to which they are secured. FIG. 14 broadly illustrates the preferred hydraulic circuit 220.

As seen in FIG. 9, the typical rotor assembly mounting region 58 is defined between various frame elements, comprising frame end 31, base 29, strut 40 and brace 56. It is contemplated that a separate subframe comprised essentially of the latter elements may be fabricated separately from the main frame.

Figure 12:
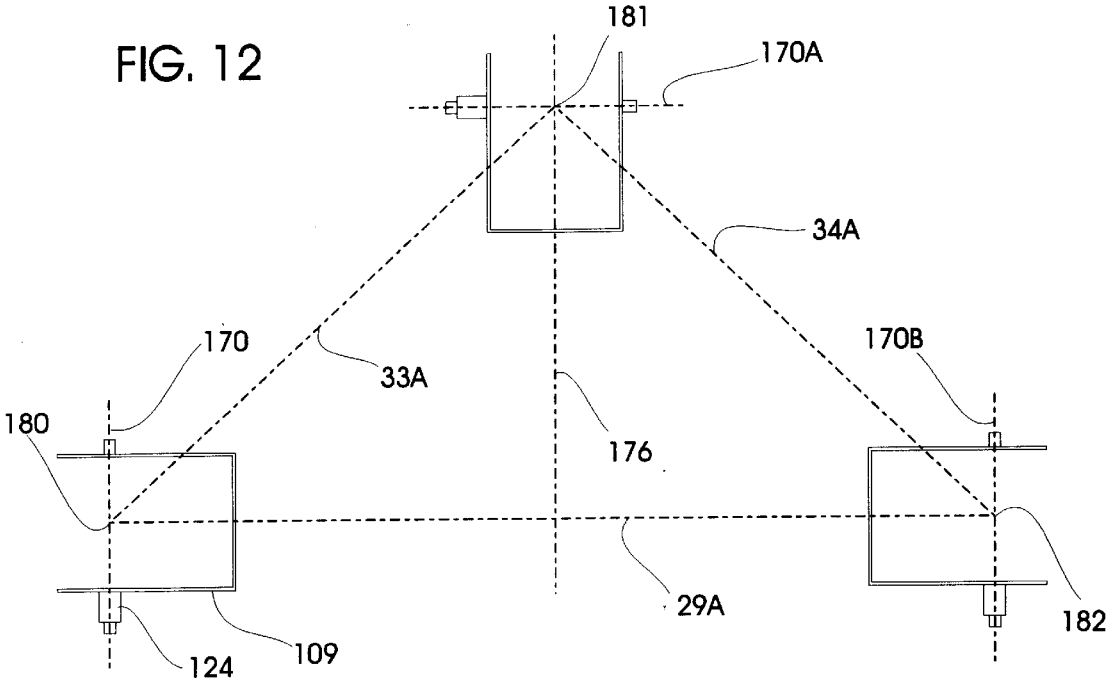
FIG. 12 is a free body diagram showing the preferred frame layout.
Figure 13:
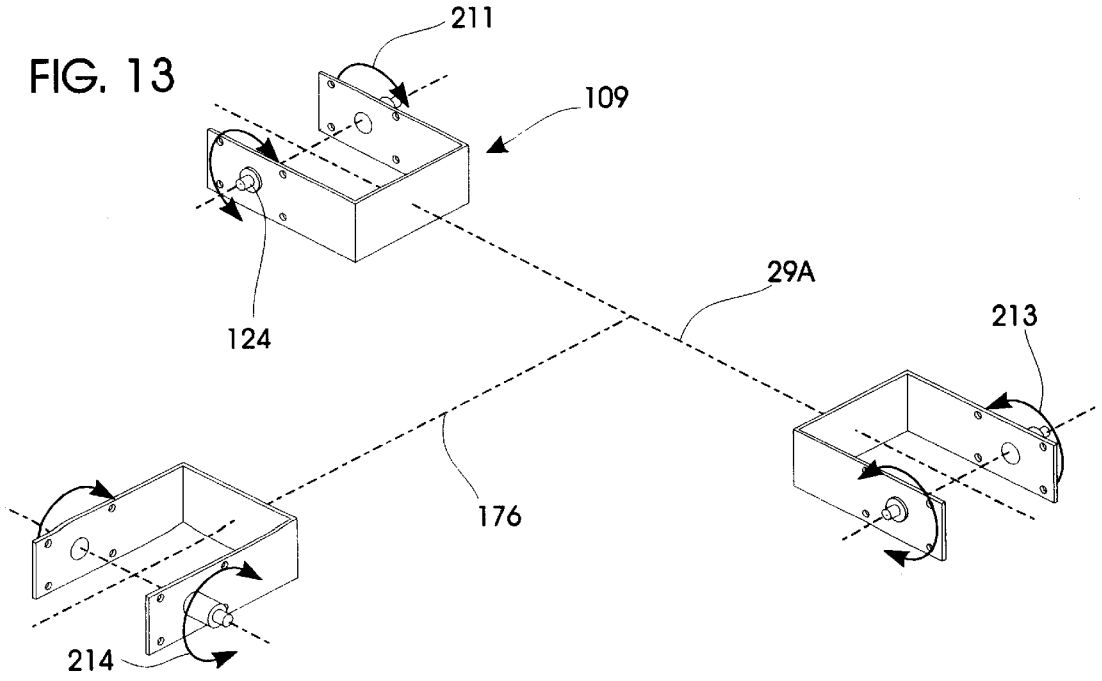
FIG. 13 is a fragmentary, pictorial view of the preferred rotor tiliting mechanisms.

Turning to FIGS. 12 and 13, the pivot steering box 109 previously discussed is shown schematically. Its axis of rotation (in the three rotor mode) has been generally designated by the dashed line 170. Similarly the axis of rotation of the front pivot steering box has been designated by the reference numeral 170A and the axis of rotation of the right rear pivot steering box has been designated by the reference numeral 170B. As can be seen from FIGS. 12 and 13, the plane of rotation of the rotor assemblies at the rear occupies a plane generally coincident with line 29A. The latter steering plane is perpendicular to the plane of the rotation of the front rotor designated by dashed line 176 (FIG. 12). In other words, the plane of rotation of the front pivot steering box is substantially perpendicular to the plane of rotation of the rear rotors. As seen in FIG. 13, the axis of rotation of the left rear pivot steering box (indicated by arrow 213) is parallel with the axis of rotation of the right rear box (indicated by arrow 211). The axis of rotation of the front pivot steering box, indicated by arrow 214, is thus perpendicular to the axis of rotation of either rear rotor.

Points 180, 181 and 182 represent the effective free-body vertices of the dynamic triangular frame of the three rotor trowel. In other words, points 180–182 represent the concentration of mass or the center of mass of the rotor/motor assemblies disposed generally at the vertices of the triangular frame. As can best be viewed from FIG. 11, the sides of the frame are equal and the triangular configuration is isosceles. The preferred angle between the base and each side is between 30 and 50 degrees. In the best mode it is approximately 42 degrees. In the best mode known to us at this time, the distance between points 180 and 182 (i.e., the base of the triangle) is 81 inches. The distance between point 181 and line 29A (FIG. 12), corresponding to the altitude of the triangle, is approximately 37 17/64 inches. Experimentation has revealed that for best steering control, the altitude should be approximately 40%–50% of the base width.

In addition to the dimensional relationships discussed above, weight distribution must be correctly established for optimum results in the three rotor embodiment. Experimentally it appears that the weight at the left rear rotor (point 180 in FIG. 12) and right rear rotor (at point 182) will vary between 800–1000 pounds each. These rear rotors should ideally be weighted within 10%–15% of each other. The best mode known at this time requires approximate 50%–70% of this weight at the front rotor at point 181 (FIG. 12). In the best mode, with all water tanks (i.e., for optional sprayers not shown), fuel tanks, and hydraulic tanks full, the observed weight at point 180 is 842 pounds. The weight at point 182 is 948 pounds, and the weight at point 181 (FIG. 12) at the front is 418 pounds.

Figure 10:
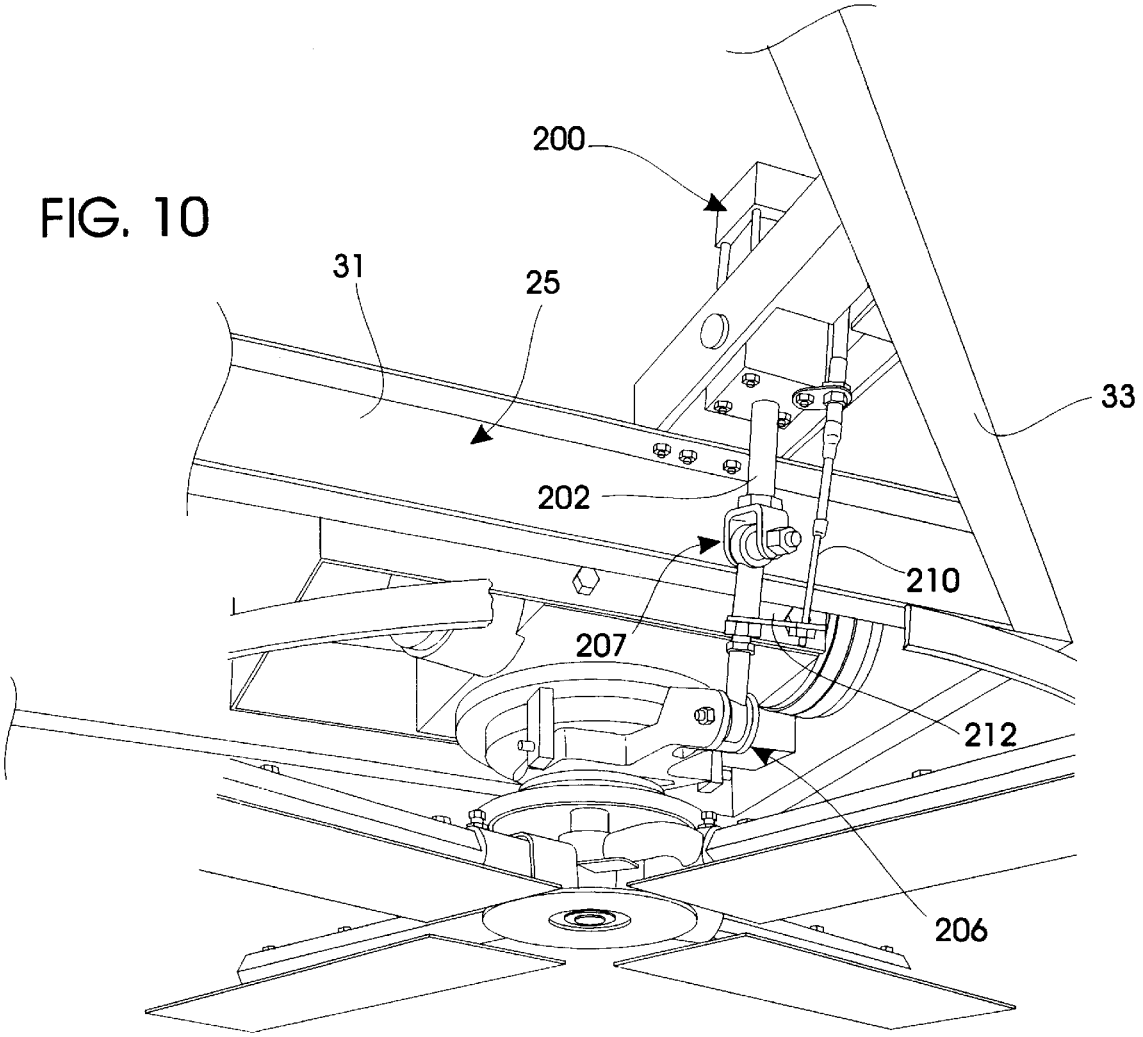
FIG. 10 is an enlarged, fragmentary perspective view of the underside of the a typical rotor showing blade pitch control, taken generally from a reference point established by line 10—10 in FIG. 3.

Turning now to FIG. 10, an auxiliary hydraulic control unit 200 operates a plunger 202 that is interconnected to the fork 206 operating the rotor assembly thereshown. The operation of the pitch control fork 206 has been explained previously in conjunction with my above referenced patents. Hydraulic control 200 is coupled to the fork through a suitable connection 207. A cable 210 connected to a plate 212 travels with the fork 206 in response to hydraulic actuation. Cable 210 leads to a blade pitch indicator (not shown). Once hydraulic instructions have been conveyed to control 200 through the joy-stick controllers 24, previously discussed, the pitch of the various blades (i.e., established by the position of the fork 207) can be selected.

Referring to FIG. 14, the preferred hydraulic circuit has previously been identified with reference numeral 220. A multiple rotor riding trowel 221 employs at least one of its internal combustion engines 222 to drive hydraulic pump 223. The pump circulates fluid stored in reservoir 255, suctioning through the circuitry as indicated by arrowhead 224. The solenoid control valves are arranged in a manifold identified schematically by the reference numeral 225 that comprises valve banks 226 and 226B. The first bank 226 of hydraulic valves responsible for steering is energized via line 241. Bank 226B, responsible for blade pitch, is connected to the "T" port of valve 229 on line 230. The pitch control solenoid valves 240, 240A and 240B in bank 2268 are interconnected by flow lines 230, 230A and 230B.

Bank 226 comprises a plurality of four way, three position solenoid actuated hydraulic valves 227, 228, and 229. The "T" ports are tied together. These valves are respectively connected to tilting cylinders 150 (FIG. 14), 150A, and 150B. For example, ports A1 and B1 of valve 227 control cylinder 150. Normally one tilting cylinder is associated with each rotor assembly. However, as explained in the aforementioned patents, a twin rotor trowel differs from a three rotor trowel in that one of its rotor assemblies must pivot in two planes for steering. Thus with a twin rotor trowel, the instant hydraulic system might associate both cylinders 150A and 150 with a single rotor assembly.

Cylinder bank 226B comprises solenoid activated hydraulic valves 240, 240A and 240B. These respectively actuate pitch control pistons 200 (i.e., FIGS. 10, 14), 200A, and 200B normally associated with the different rotors. Ports A4 and B4 of valve 240, for example, control cylinder 200. When activated, they control blade pitch by deflecting the pitch control fork previously discussed.

Pump 223 (FIG. 14) transmits through line 241 to flow divider 232 (FIG. 14). Flow from section one of divider 232 appears on line 243A and reaches cartridge relief valve 244A and port P1 of the four way valve 227 via line 245. Solenoid 227A establishes normal flow; solenoid 227B reverses the flow across ports A1 and B1. Similarly, the flow from sections two and three of divider 232 outputted on lines 243B and 243C respectively reaches cartridge relief valves 244B, 244C and solenoid valves 228, 229. Relief valves 244A–244C are set to 450 P.S.I. in the best mode. Valves 228 and 229 have similar solenoids that are electrically energized to reverse flow across their output ports A2, B2 and A3, B3 respectively. The double acting cylinders are thus extended or retracted. Each valve 227–229 has a pair of flexible lines 247A–247C respectively interconnecting its output ports to the tilt cylinders 150–150B. foward-reverse propulsion is primarily established by valves 227 and 229 that tilt the right and left rear rotor assemblies respectively in a plane parallel with the bicycle planes. Left-right steering is established additionally by valve 228 that tilts the center or front rotor assembly (i.e., in the three rotor embodiment) in a plane perpendicular to the biaxial plane. The circuit return is completed by lines 250 and 251 and line 253. The main relief valve 254 is coupled across the circuit by line 242; in the best mode it is set at 550 P.S.I. Return to reservoir 255 is indicated by arrowhead 255A. Reservoir 255 is vented by breather 256. Electrical control will be detailed hereinafter. The other tilt valves 228, 229 operate similarly. Absence of solenoid control signals establishes a neutral steering position; cylinder deflection to a neutral position occurs because of the weight borne by the rotor assemblies.

The pitch control bank 226B is powered through the third section of flow divider 232 and the T port of valve 229 on lines 230, 230A and 230B. Valves 240–240B control cylinders 200, 200A, 200B via their respective A and B ports. These valves have solenoids similar to solenoids 227A and 227B previously discussed. In the best mode pilot operated check valves 260A–260C bypass the latter cylinders.

The right hand lever control (FIGS. 1, 2) is a four direction, two axle joystick 24A that can be deflected between forward-neutral-reverse positions and left-neutral-right positions. The particular mechanical movement was selected for backwards compatibility with older twin rotor trowels; the joystick motions correspond generally with the mechanical hand-lever movements necessary for steering older twin rotor trowels.

Electric circuit 300 (FIG. 15) is operated by the right hand joystick. Power (i.e., nominally 12 or 24 volts D.C.) is applied across lines 301 and 302. When the right joystick is moved forwardly switch contacts 303 close, activating solenoid field 305 that energizes solenoid 227A (FIG. 14) to pressure port A1 of valve 227 for forward steering. Moving the right joystick rearwardly activates contacts 304 to energize solenoid field 306 and solenoid 227B (on valve 227), activating port B1 and reversing cylinder 150. Movement of the right joystick to the right activates solenoid field 308 through contacts 309 to activate port A2 on valve 228 for steering right. Similar movement of the right hand joystick to the left activates solenoid field 310 through contacts 311 for steering left; at this time port B2 on valve 228 is pressured. Push button switch 314 operates relay 315 and LED indicator 316; relay 315 closes switch contacts 318 to energize the running lights 320. Other electrical accessories can be powered in this fashion.

The left hand lever control (FIGS. 1, 2) is a two direction, one axis joystick 24B; it can be deflected between forward, neutral, and reverse selections. Again, the particular mechanical movement establishes backwards compatibility with older riding trowels. Blade pitch control switches are incorporated in the handle; there is a toggle control switch for pitch control of each rotor. The left hand joystick operates circuit 400 (FIG. 16).

Figure 16:
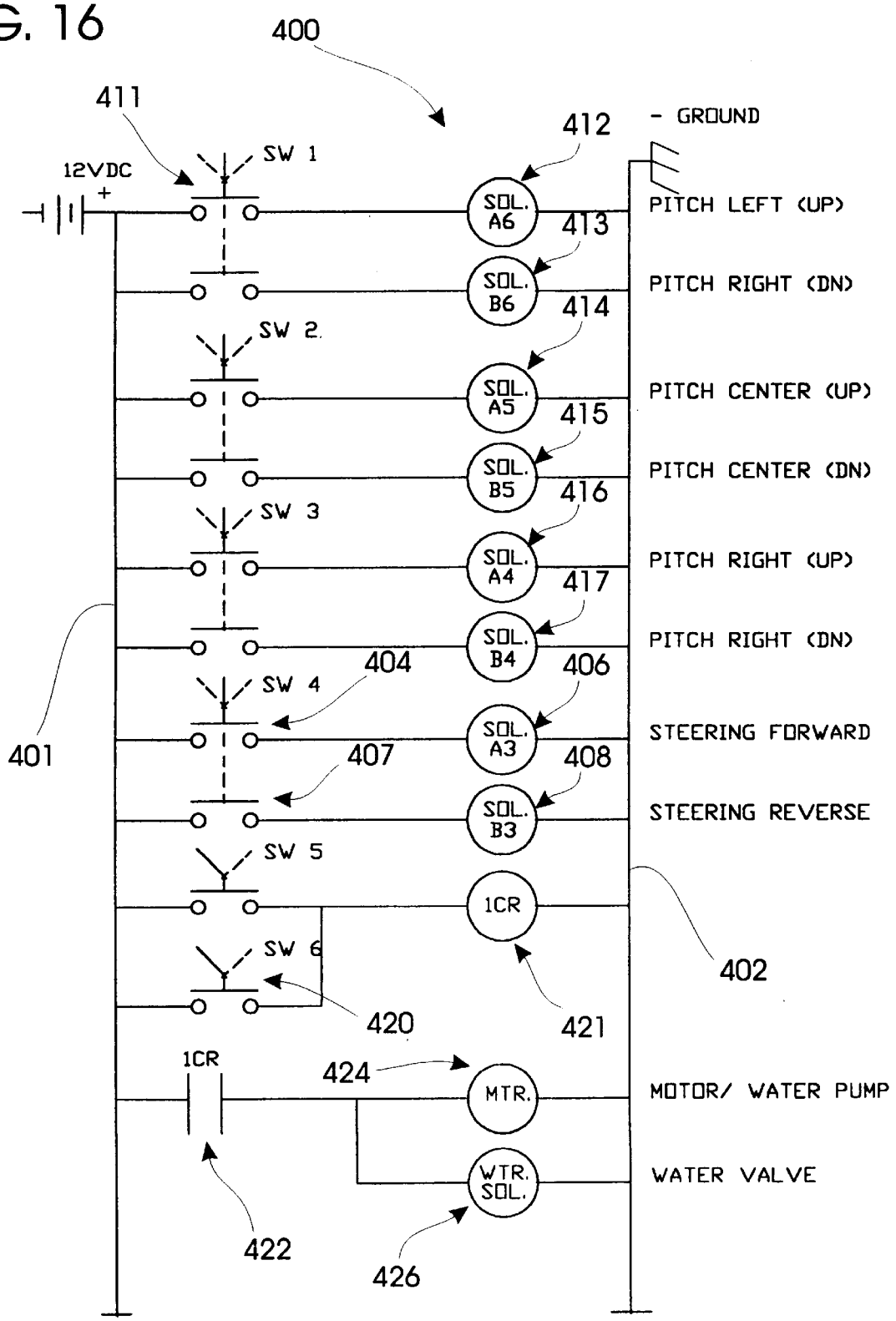

In circuit 400 source voltage is applied across lines 401, 402 (FIG. 16). When the left joystick is pushed forwardly (i.e., concurrently with the right joystick) to move the trowel forwardly, contacts 404 are closed to energize solenoid field 406. This activates port A3 of valve 229 (FIG. 14) and cylinder 150B. Pulling the left hand joystick rearwardly closes contacts 407 to energize solenoid field 408; this activates port B3 of valve 229 and retracts cylinder 150B.

To control blade pitch, three single pole double throw toggle switches are preferred (FIG. 16). When switch contacts 411 are closed to energize solenoid field 412, port A6 of valve 240B (FIG. 14) is activated to change blade pitch with cylinder 200B. Solenoid fields 413–417 are similarly energized by the contacts and movements illustrated in FIG. 16. The respective solenoid valve "A" and "B" ports indicated in FIG. 16 correspond to the labeled ports in FIG. 14. Switch contacts 420 activate relay filed 421 to close relay contacts 422. This energizes an optional spray pump motor 424 and a water valve 426.

Operation

In operation a variety of operator precautions must be observed, as is the case with prior art motorized trowels. The hydraulic tanks should be periodically inspected for proper level, and the rotor blades must be changed as necessary after routine inspections for wear. Fuel tank levels must be sufficient for extended periods of use. During the initial finishing of wet concrete, proper pans will first be installed on the rotors by coupling the rotor blades to the radially spaced apart brackets provided.

Normally the engines are started one at a time. With all engines running, throttle control of each occurs concurrently by pressure on the foot control. Once the engines are running, suitable throttle speed will be sufficient to activate the clutches causing rotor rotation. Once the rotors are activated, the joystick controls may be activated to steer and control the trowel. As the joysticks are used, electrical connections seen in FIGS. 15 and 16 will activate corresponding hydraulic control valves (FIG. 14) to tilt the various rotors for propulsion and steering. Because of the inherent "backwards compatibility" established by the steering controls, the required hand movements for steering and control are the same as required with older two rotor machines that steer with large, manually deflected levers.

If pressure is applied to the inside of the left and right rear rotors by tilling them appropriately with the double acting cylinders, then the machine will move in reverse. This occurs when the joysticks are pulled rearwardly. Again, in the best mode known at this time, during reverse travel the front rotor is neutral.

To move left, with the rear rotors untilted (i.e., neutral) subsequent tilting of the front rotor to concentrate pressure at its front (i.e., at the front of the riding trowel) will cause the trowel to make a left hand, wide sweeping turn. At this time the front rotor revolves as indicated by arrow 82 (FIG. 3). Again, with the rear rotors untilted (i.e., neutral) tilting of the front rotor to concentrate pressure at its rear (i.e., towards the interior of the riding trowel frame) will cause the trowel to make a right hand, wide sweeping turn. At this time the right hand joystick is moved to the right.

If pressure is applied to the outside of the right rotor and the inside of the left rotor, with the front rotor neutral, the trowel will execute a hard left turn. Again the front rotor is neutral. To "crab" left, i.e., move sideways leftwardly, pressure is applied to the front of the front rotor and to the outside of the rear rotors. To "crab" right pressure is applied to the rear of the front rotor and to the outside of the rear rotors. Obviously by varying the inclination of the rotors in a plurality of other combinations a wide variety of trowel maneuvers can be executed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For a self propelled riding trowel of the type comprising a frame, internal combustion engine means secured to said frame, and two or more revolving, bladed, rotor assemblies pivoted to said frame and driven by said engine means, a power steering system comprising:

pump means driven by said internal combustion engine means for supplying hydraulic pressure;

hydraulic circuit means powered by said pump means for operating the power steering system, said circuit means comprising:

tilting cylinder means for tilting the rotor assemblies to effectuate trowel steering and maneuvering;

valve means for controlling said tilting cylinder means; and, actuator means for selectively activating said valve means;

left and right joysticks accessible to a trowel operator for operating said actuator means whereby the operator of the trowel can steer and control the riding trowel hydraulically; and, wherein the left and right joysticks move generally with the same mechanical hand-lever movements necessary for steering manual steering riding trowels thereby establishing backwards compatibility.

2. The steering system as defined in claim 1 further comprising second cylinder means for varying rotor assembly blade pitch.

3. The steering system as defined in claim 2 wherein:

said trowel frame comprises a plurality of rotor assembly mounting regions, each rotor assembly comprises a motor driven gear box and a pivot steering box of generally U-shaped cross section for securing the gear box;

each pivot steering box comprises trunnions pivoted to said frame for supporting the rotor assembly and enabling pivoting in response to said cylinder means; and said trowel comprises pivot stop means for mechanically limiting gear box pivoting.

4. A motorized riding trowel for finishing a concrete surface, said riding trowel comprising:

a rigid frame;

internal combustion motor means for powering said trowel;

hydraulic pump means driven by said motor means for supplying hydraulic pressure;

rotor assemblies pivotally suspended from said frame for supporting and powering said riding trowel and finishing said concrete, said rotor means comprising a plurality of radially spaced apart blades for frictionally contacting the concrete;

cylinder means for selectively tilting said rotor assemblies to effectuate steering and control;

hydraulic circuit means powered by said pump means for operating the power steering system, said circuit means comprising:

tilting cylinder means for tilting the rotor assemblies to effectuate trowel steering and maneuvering;

valve means for controlling said tilting cylinder means; and, actuator means for selectively activating said valve means;

left and right joysticks accessible to a trowel operator for operating said actuator means whereby the operator of the trowel can steer and control the riding trowel hydraulically; and, wherein the left and right joysticks move generally with the same mechanical hand-lever movements necessary for steering manual steering riding trowels thereby establishing backwards compatibility.

5. The trowel as defined in claim 4 wherein said hydraulic circuit means comprises second cylinder means for varying rotor assembly blade pitch.

6. The trowel as defined in claim 4 wherein:

said trowel frame comprises a plurality of rotor assembly mounting regions, each rotor assembly comprises a motor driven gear box and a pivot steering box of generally U-shaped cross section for securing the gear box;

each pivot steering box comprises trunnions pivoted to said frame for supporting the rotor assembly and enabling pivoting in response to said cylinder means; and said trowel comprises pivot stop means for mechanically limiting gear box pivoting.

7. A motorized riding trowel for finishing a concrete surface, said riding trowel comprising:

a rigid frame;

internal combustion motor means supported by said frame for powering said trowel;

a plurality of rotor assemblies pivotally suspended from said frame for supporting and powering said riding trowel and finishing said concrete, each rotor assembly comprising a plurality of radially spaced apart blades for frictionally contacting the concrete;

electric over hydraulic power steering means for controlling trowel steering and maneuvering, said power steering means comprising:

hydraulic pump means driven by said internal combustion motor means for supplying hydraulic pressure;

tilting cylinder means for tilting the rotor assemblies to effectuate trowel steering and maneuvering;

hydraulic circuit means powered by said pump means for operating the tilting cylinder means, said hydraulic circuit means comprising solenoid valve means for hydraulically pressuring the tilting cylinder means in response to electric signals;

electric circuit means for selectively outputting said electric signals; and, left and right joysticks accessible to a trowel operator for operating said electric circuit means whereby the operator of the trowel can steer and control the riding trowel electro-hydraulically.

8. The trowel as defined in claim 7 wherein said hydraulic circuit means comprises second cylinder means for varying rotor assembly blade pitch, and said electric circuit means comprises means associated with said joystick means for electrically activating said second cylinder means.

9. A motorized riding trowel for finishing a concrete surface, said riding trowel comprising:

a rigid, generally triangular frame having two rear vertices and a spaced apart front vertice;

a front rotor assembly and a pair of spaced apart rear rotor assemblies for powering said riding trowel and frictionally contacting said concrete, the rear rotor assemblies mounted upon adjacent rear vertices and said front rotor assembly mounted adjacent said front vertice, wherein each rotor assembly comprises a plurality of radially spaced apart blades for frictionally contacting the concrete being finished;

internal combustion motor means supported by said frame for powering said trowel;

electric over hydraulic power steering means for controlling trowel steering and maneuvering, said power steering means comprising:

hydraulic pump means driven by said internal combustion motor means for supplying hydraulic pressure;

a pair of tilting cylinders for tilting the rear rotor assemblies in a plane parallel with a biaxial plane established by the axis of rotation of said rear rotor assemblies, and another tilting cylinder for tilting the front rotor assembly in a plane perpendicular to said biaxial plane, whereby to effectuate trowel steering and maneuvering;

hydraulic circuit means powered by said pump means for operating the tilting cylinders in response to electric signals, said hydraulic circuit means comprising a bank of tilting solenoid valves, one solenoid valve associated with each tilting cylinder;

electric circuit means for selectively outputting said electric signals; and, left and right joysticks accessible to a trowel operator for operating said electric circuit means whereby the operator of the trowel can steer and control the riding trowel electro-hydraulically.

10. The trowel as defined in claim 9 wherein:

each rotor assembly comprises a pitch control cylinder;

said hydraulic circuit means comprises a bank of pitch control solenoid valves for actuating the pitch control cylinders, one pitch control solenoid valve associated with each pitch control cylinder; and, said electric circuit means comprises means associated with said joystick means for electrically activating said bank of pitch control cylinders.

11. The trowel as defined in claim 10 wherein said hydraulic circuit means bank of tilting solenoid valves hydraulically series feeds said bank of pitch control solenoid valves.

12. The trowel as defined in claim 10 wherein said hydraulic circuit means comprises flow divider means for independently pressuring each tilting solenoid valve.

* * * * *